United States Patent [19]

Brauner

[11] 4,339,068

[45] Jul. 13, 1982

[54] PAPERBOARD FOOD CARTON

[75] Inventor: Arne H. Brauner, Peekskill, N.Y.

[73] Assignee: International Paper Company, New York, N.Y.

[21] Appl. No.: 200,715

[22] Filed: Oct. 27, 1980

[51] Int. Cl.[3] ..... B65D 5/24

[52] U.S. Cl. ..... 229/33; 229/23 BT; 229/44 R

[58] Field of Search ..... 229/33, 44 R, 35, 36, 229/23 BT, 31 R, 45, 43; 220/4 B

[56] References Cited

U.S. PATENT DOCUMENTS

| | | | |
|---|---|---|---|
| 2,031,834 | 2/1936 | Klefeker | 229/14 |
| 2,079,815 | 5/1937 | Ringler | 229/15 |
| 2,777,630 | 1/1957 | Moberger | 229/45 |
| 3,027,062 | 3/1962 | Huss et al. | 229/23 |
| 3,124,293 | 3/1964 | Transport | 229/16 |
| 3,433,402 | 3/1969 | Persson | 229/33 |
| 3,542,569 | 12/1970 | Farquhar | 99/174 |
| 3,627,541 | 12/1971 | Farquhar | 99/171 R |
| 3,693,865 | 9/1972 | Desmond et al. | 229/33 |
| 3,747,832 | 7/1973 | Chapman | 229/31 R |
| 3,827,624 | 8/1974 | Dogliotti | 229/45 |
| 3,968,922 | 7/1976 | Ruud | 229/33 |
| 4,232,816 | 11/1980 | Johnson et al. | 229/33 |
| 4,266,713 | 5/1981 | Maroszek | 229/36 |

FOREIGN PATENT DOCUMENTS

| | | | |
|---|---|---|---|
| 640589 | 5/1962 | Italy | 229/23 BT |

*Primary Examiner*—William Price
*Assistant Examiner*—Gary E. Elkins
*Attorney, Agent, or Firm*—Richard J. Ancel

[57] ABSTRACT

The present invention is directed to a nestable, food carton formed from a unitary blank of foldable paperboard that converts into a two-compartment serving tray for products such as sandwiches, hamburgers, and the like. It comprises a bottom tray, a top cover, and means connecting the bottom tray to the top cover. The bottom tray comprises a base wall; a front wall, a rear wall, and a pair of side walls, each hingedly connected to, and extending from, the base wall. The top cover is dome-shaped and comprises a top wall; a front wall, a rear wall, and a pair of side walls, each hingedly connected to, and extending from, the top wall. The connecting means comprises a panel hingedly connected to the outer edge of the rear wall of the bottom tray and to the outer edge of the rear wall of the top cover. The connecting means is adapted to permit the top cover to substantially overlie, fully cover, and extend to the base wall of the bottom tray when the carton is closed, and to permit the base wall of the bottom tray and the top wall of the top cover to lie in the same horizontal plane when the carton is open, thereby forming two food serving compartments.

8 Claims, 5 Drawing Figures

PAPERBOARD FOOD CARTON

BACKGROUND OF THE INVENTION

This invention relates to a paperboard food carton that converts into a two-compartment serving tray. Many food products, such as sandwiches, hamburgers, and the like, are packaged in paperboard cartons and are sold by fast food restaurants. These food products are generally to be eaten without plates. Hence, it is desirable for such food cartons to be able to act as serving trays. Moreover, the sandwiches are frequently purchased with other food items such as french fried potatoes, and it is especially useful for the trays to form two serving compartments.

Currently, many of the paperboard food cartons sold in fast food restaurants resemble clam shells, and they are so called because they have two outwardly tapering compartments that are hinged together and close around the product to fully enclose it. However, the manner in which such cartons close is imprecise, causing open gaps at the side closure points that permit the moisture vapor and heat from the food product to escape.

SUMMARY OF THE INVENTION

This invention provides a carton for a food product, which can be rapidly assembled, retards the escape of heat and moisture vapor from the food product when the carton is in a closed condition, and can be used as a two-compartment serving tray when opened. The carton comprises a bottom tray, a domed top cover that extends substantially to the base wall of the bottom tray, and means connecting the bottom tray to the domed top cover. The connecting means comprises a floating hinge or a panel that is hingedly connected to both the bottom tray and the top cover.

The full nature of the invention will be understood from the accompanying drawings and the following description and claims. It should be understood, however, that references in the following description to front, rear, and side walls and panels are for convenience of description, and such terms are not intended to be used in a limiting sense.

DETAILED DESCRIPTION OF THE INVENTION

Figure 1:
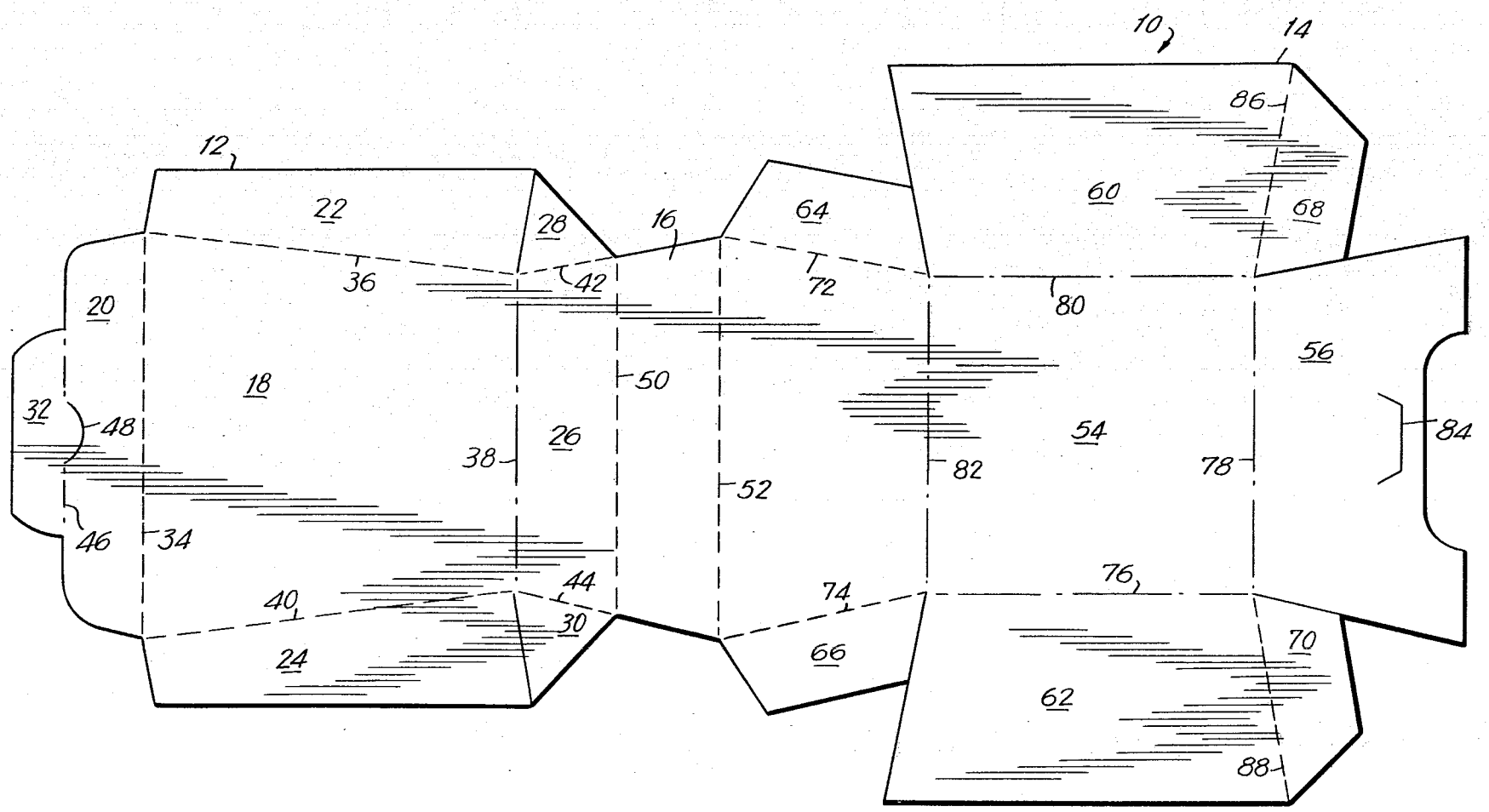
FIG. 1 is a top plan view of the cut and scored, unitary blank that is used to form the carton illustrated in FIGS. 2–5.

Reference is first made to FIG. 1 for a description of the blank employed in forming the carton illustrated in FIGS. 2–5. Unitary blank 10 comprises bottom tray-forming section 12, top cover-forming section 14, and means 16 connecting the bottom tray-forming section 12 to top cover-forming section 14.

Bottom tray-forming section 12 comprises a base wall 18, front wall 20, rear wall 26, and side walls 22, 24.

Front wall 20 is hingedly connected to base wall 18 along score line 34. Side walls 22, 24 are hingedly connected to base wall 18 along score lines 36, 40, respectively, and rear wall 26 is hingedly connected to base wall 18 along score line 38. A pair of first glue flaps 28, 30 are hingedly connected to opposite edges of rear wall 26 along score lines 42 and 44, respectively.

Front wall 20 is hingedly connected to closing flap 32 along slit and score line 46. Line 46 includes a semi-circular line of cut in its center portion thereby forming an integral locking tab 48 which, as will be explained below, is adapted to releasably engage a locking slot formed in the front wall of the top cover.

The top cover-forming section 14 comprises a top wall 54 which is hingedly connected to side walls 60 and 62 along score lines 80, 76, respectively; to rear wall 58 along score line 82; and to front wall 56 along score line 78. A pair of second glue flaps 64 and 66 are hingedly connected to opposite edges of rear wall 58 along score line 72 and 74, respectively, and a pair of third glue flaps 68 and 70 are hingedly connected to side walls 60 and 62 along score lines 86 and 88, respectively. Front wall 56 includes a locking slot 84, which is formed by an incision in the front wall 56, that allows top cover 14 to securely engage the bottom tray 12 when the carton contains the food product and is in the closed position.

An important aspect of the present invention is the floating hinge or panel 16 that permits the top cover 14: (a) to substantially overlie and completely cover the bottom tray 12 when the carton is closed; and (b) to pivot from the rear wall 26 of the bottom tray when the carton is opened to thereby form a two-compartment serving tray. As shown in FIG. 1, panel 16 is connected to the outer edge of the rear wall 26 of bottom tray 12 along score line 50 and to the outer edge of rear wall 58 of top cover 14 along score line 52. As employed herein, outer edge means that edge of rear wall 26 that is furthest away from base wall 18 and that edge of rear wall 58 that is furthest away from top wall 54.

Figure 2:
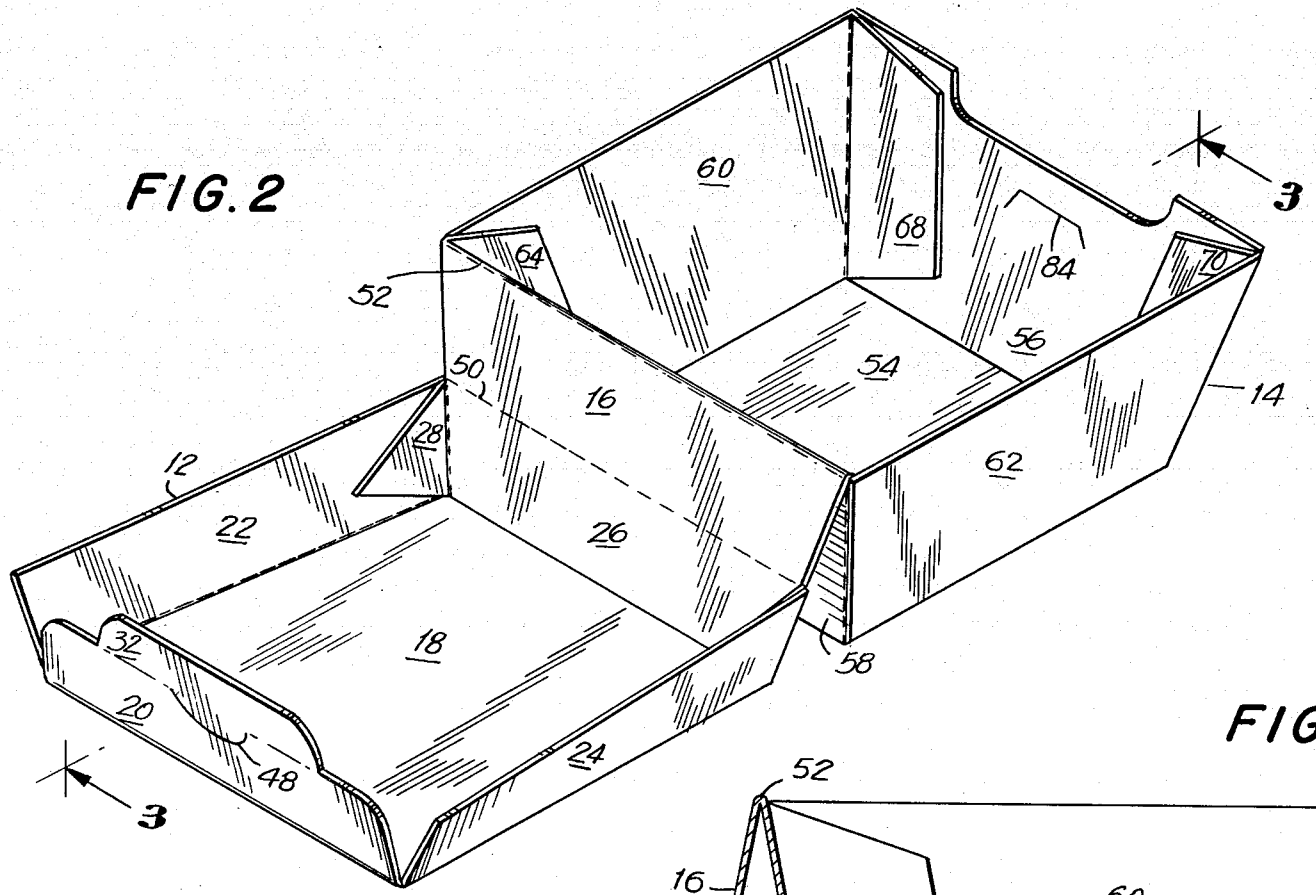
FIG. 2 is a perspective view of the erected carton in the open position.

As is shown in FIG. 2, the carton fabricated from the unitary blank 10, illustrated in FIG. 1, when opened, forms two food serving trays or compartments, wherein each compartment is adapted to lie securely in the same horizontal plane when placed on a flat surface.

The first serving compartment is formed from bottom tray 12, and the second serving compartment is formed from domed top cover 14. Bottom tray 12 comprises base wall 18, side walls 22 and 24, front wall 20, and rear wall 26. Domed top cover 14 comprises base wall 54, side walls 60 and 62, front wall 56, and rear wall 58. Connecting bottom tray 12 to domed top cover 14 is connecting means 16.

Connecting means 16 comprises a panel or a floating hinge that is connected to bottom tray rear wall 26 along score line 50 and to top cover rear wall 58 along score line 52. Floating hinge 16 permits the carton blank to be glued at six points, on relatively standard equipment, such as a Kliklok HSWD or FFWD-C machine, having tooling adapted for this carton. A pair of first glue flaps 28, 30 on bottom tray 12 are glued to the inner surface of the bottom tray side walls 22, 24; a pair of second glue flaps 64, 66 are glued to the inner surface of top cover side walls 60, 62; and a pair of third glue flaps 68, 70 are glued to the inner surface of top cover front wall 56. Hence, floating hinge 16 allows top cover 14 and base tray 12 to be glue-formed in such a way that the finished cartons can be pre-formed and nested in each other. It also allows top cover 14 to pivot and swing into a position that extends substantially to the base of the bottom tray 12 and substantially overlies and fully covers the bottom tray 12 when the carton is in the closed position illustrated in FIGS. 4 and 5, but which allows the carton to be opened, by the ultimate user, in such a manner that base tray 12 can be used as a receptacle for a fast food product, such as a sandwich or a hamburger, and domed top cover 14 can be used as a receptacle for a second food product such as french fried potatoes.

Figure 3:
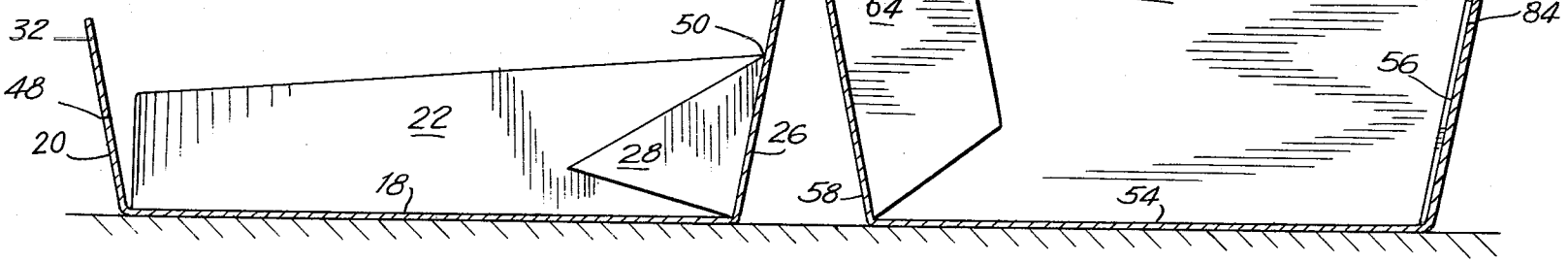
FIG. 3 is a cross-sectional view taken along line 3—3 of FIG. 2.
Figure 5:
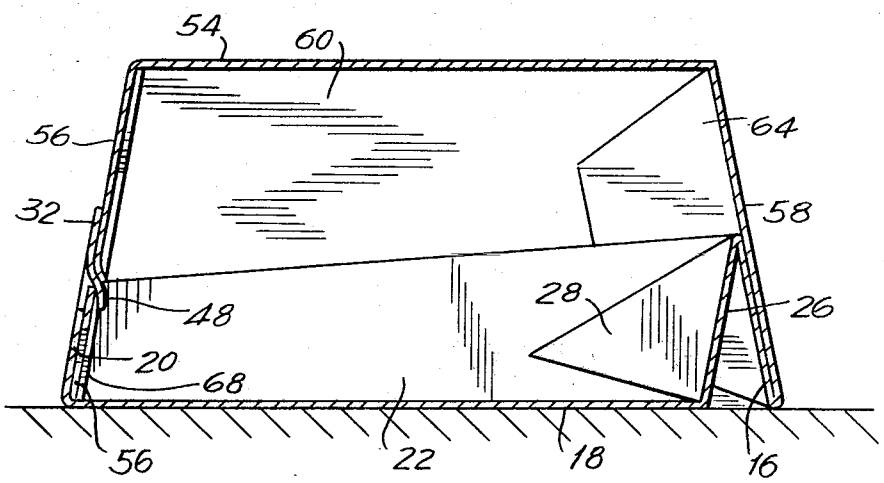
FIG. 5 is a cross-sectional view taken along line 5—5 of FIG. 4.

As is evident in FIGS. 3 and 5, when the carton is glued and erect, floating hinge panel 16 is detached; it is neither glued to the rear wall 26 of the bottom tray 12, nor to the rear wall 58 of domed cover 14. Moreover, it is not functionally stationary. Instead, its construction permits the cover to be flexible in its function, namely, when the carton is closed, the position of the domed cover 14 retards the escape of moisture vapor and heat from the food product, and when the carton is open, it permits the domed cover 14 to act as a second food compartment. It will be noted that when the carton is closed, panel 16 abuts rear wall 58 of top cover 14 and not rear wall 26 of bottom tray 12.

It will also be noted from FIGS. 2 and 3 that when the carton is open, the height of rear wall 58 of top cover 14 is substantially equal to the combined heights of the connecting means 16 and the rear wall 26 of bottom tray 12.

Figure 4:
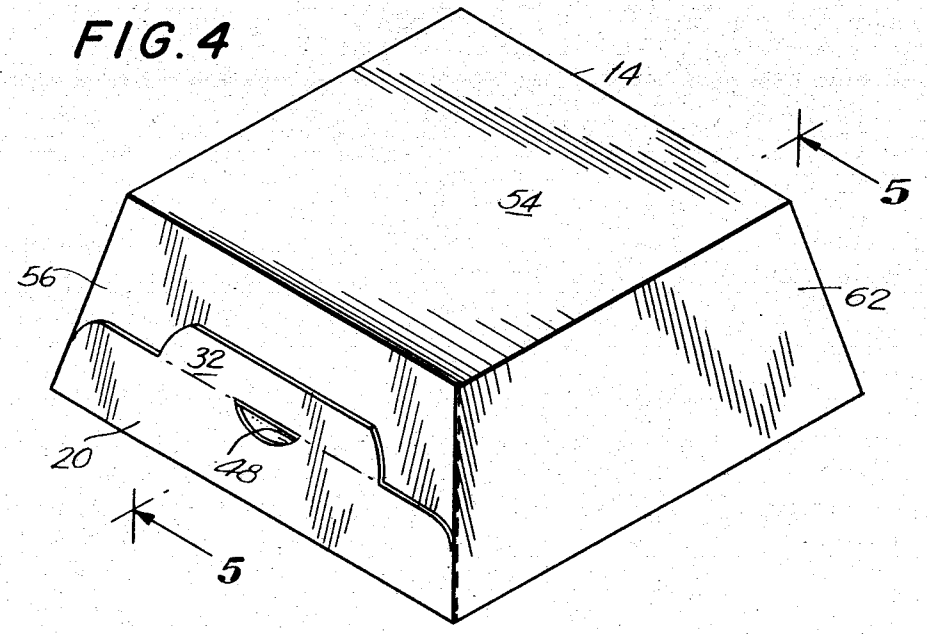
FIG. 4 is a perspective view of the carton in erected and closed position.

As is illustrated in FIGS. 4 and 5, top cover 14 can be locked to bottom tray 12 by the engagement of latching means, namely, locking tab 48 on closing flap 32 and locking slot 84, which is formed by an incision in top cover front wall 56. To open the closed carton illustrated in FIG. 4, the user simply grasps locking panel 32, gently separates it from the carton, and then raises top cover 14, thereby allowing floating hinge 16 to pivot around score lines 50 and 52 to form the two-compartment serving tray illustrated in FIG. 2.

The carton, which is preferably formed from the blank illustrated in FIG. 1, may be made from any suitable foldable material. Preferably, it is made of paperboard or the like, and suitable paperboard stock, for example, is 0.014 SBS. The surfaces of the carton may also be coated with barrier materials to aid in retaining the heat and moisture from the product. For example, the exterior of the carton may be coated with a saran-type coating, which acts as a moisture vapor barrier. The interior of the carton may be coated with solvent-based nitrocellulose coatings or with aqueous, modified acrylic coatings, which provide a liquid moisture barrier and a degree of grease resistance. It will be recognized, however, that certain food products will permit the use of uncoated cartons.

Generally speaking, the present invention is directed to a nestable food carton formed from a unitary blank of foldable paperboard that converts into a two-compartment serving tray for products such as sandwiches, hamburgers, and the like. It comprises a bottom tray, a top cover, and means connecting the bottom tray to the top cover. The bottom tray comprises a base wall; a front wall, a rear wall, and a pair of side walls, each hingedly connected to, and extending from, the base wall. The top cover is dome-shaped and comprises a top wall; a front wall, a rear wall, and a pair of side walls, each hingedly connected to, and extending from, the top wall. The connecting means comprises a panel hingedly connected to the outer edge of the rear wall of the bottom tray and to the outer edge of the rear wall of the top cover. The connecting means is adapted to permit the top cover to substantially overlie, fully cover, and extend to the base wall of the bottom tray when the carton is closed, and to permit the base wall of the bottom tray and the top wall of the top cover to lie in a horizontal plane when the carton is open, thereby forming two food serving compartments.

Although the invention has been described above by reference to a preferred embodiment, it will be appreciated that other carton constructions may be devised, which are, nevertheless, within the scope and spirit of the invention and are defined by the claims appended hereto.

What is claimed is:

1. A food carton formed from a unitary blank of foldable paperboard comprising:

a bottom tray; a top cover; means to connect said bottom tray to said top cover; and means on said bottom tray and said top cover to securely close said carton;

said bottom tray comprising:

a base wall; a front wall; a rear wall; and a pair of side walls, each such wall hingedly connected to, and extending from, said base wall;

said top cover being dome-shaped and comprising:

a top wall; a front wall; a rear wall; and a pair of side walls, each such wall hingedly connected to, and extending from, said top wall;

said connecting means comprising:

a floating hinge panel pivotable about and connected by a first score line to the outer edge of the rear wall of said bottom tray and pivotable about and connected by a second score line to the outer edge of the rear wall of said top cover, said floating hinge panel being adapted to permit said top cover to substantially overlie, cover, and extend to the base wall of said bottom tray when the carton is in the closed position, and to pivot about said first and second score lines to open the closed carton and thereby to place the base wall of the bottom tray and the top wall of the top cover in the same horizontal plane to form two food serving compartments.

2. A paperboard food carton as claimed in claim 1, wherein the carton, when in the opened position, is adapted to nest one in another.

3. A paperboard food carton as claimed in claims 1 or 2, wherein said locking means comprises: (a) a closing flap hingedly connected to the front wall of said bottom tray, said closing flap including an integrally formed locking tab; and (b) a locking slot on the front wall of said top cover, said locking slot being adapted to releasably engage said locking tab to securely close the carton.

4. A paperboard food carton as claimed in claim 3, wherein the height of the rear wall of the top cover is substantially equal to the combined heights of the connecting means and the rear wall of the bottom tray, when the carton is in an open, food serving position.

5. A paperboard food carton as claimed in claim 4, wherein a first pair of glue flaps is hingedly connected to opposed edges of the rear wall of said bottom tray, said first pair of glue flaps being glued to the side walls of said bottom tray; and wherein a second pair of glue flaps is hingedly connected along opposed edges of the rear wall of said top cover, said second pair of glue flaps being glued to the respective side walls of said top cover; and wherein a third pair of glue flaps is hingedly connected to the edges of the side walls of the top cover, said third pair of glue flaps being adhered to the front wall of the top cover.

6. A paperboard food carton as claimed in claim 2, wherein the connecting means substantially abuts only the rear wall of said top cover when the carton is erect and in the closed position.

7. A unitary blank being suitably cut and scored and adapted to be erected into a nestable carton for a food product when said carton is in the glued and opened position, said blank comprising a bottom tray-forming section; a top cover-forming section; means connecting said bottom tray-forming section to said top cover-forming section; and means on said bottom tray-forming section and said top cover-forming section to securely close said carton when the blank is formed into a carton and closed;

wherein said bottom tray-forming section comprises a base wall; a pair of side walls hingedly connected to a first pair of opposed edges of said base wall; a front and a rear wall hingedly connected to a second pair of opposed edges of said base wall; and first pair of glue flaps hingedly connected to opposed side edges of said rear wall;

wherein said top cover-forming section comprises a top wall, a pair of side walls hingedly connected along a first pair of opposed edges of said top wall, a front and a rear wall hingedly connected to a second pair of opposed edges of said top wall, a second pair of glue flaps hingedly connected to opposed side edges of said rear wall, and a third pair of glue flaps hingedly connected to the edges of said side walls; and wherein said means connecting said top cover-forming section to said bottom tray-forming section comprises a floating hinge panel pivotable about and hingedly connected by first and second score lines to the outer edges of the rear walls of said bottom tray-forming section and top cover-forming section, respectively, and wherein said floating hinge panel, when the blank is formed into a glued carton, is adapted to pivot about both of said score lines when opening the closed carton but which permits said top cover to substantially overlie, cover, and extend to the base wall of the bottom tray when the blank is erected into a glued carton and the carton is in a closed position.

8. A blank as claimed in claim 7, wherei said locking means comprises: (a) a closing flap hingedly connected to the front wall of said bottom tray-forming section, said closing flap including an integrally formed locking tab; and (b) a locking slot on the front wall of the top cover-forming section, said locking slot being adapted to releasably engage said locking tab to securely close the carton erected from said blank.

* * * * *